United States Patent [19]

Berk et al.

[11] 4,389,941

[45] Jun. 28, 1983

[54] DRIVERLESS VEHICLE CONVEYOR SYSTEM

[75] Inventors: Donald M. Berk, Easton; Charles E. Jacoby, Bethlehem; Larry Reagan, Wind Gap, all of Pa.

[73] Assignee: SI Handling Systems Inc., Easton, Pa.

[21] Appl. No.: 209,243

[22] Filed: Nov. 21, 1980

[51] Int. Cl.[3] ..... B61J 1/10; B61B 13/12

[52] U.S. Cl. ..... 104/49; 104/50; 104/166; 198/472

[58] Field of Search ..... 104/35, 48–50, 104/98, 99, 165, 166; 198/472; 464/51; 74/89

[56] References Cited

U.S. PATENT DOCUMENTS

| | | | |
|---|---|---|---|
| 363,114 | 5/1887 | Burton | 104/49 |
| 1,761,747 | 6/1930 | Rosin et al. | 104/35 |
| 3,256,809 | 6/1966 | Gsell | 104/49 X |
| 3,356,040 | 12/1967 | Fonden | 104/166 X |
| 3,492,835 | 2/1970 | Polizzotto | 64/30 R X |
| 3,818,837 | 6/1974 | Jacoby | 104/166 |
| 3,858,626 | 1/1975 | Ribordy | 104/166 |
| 3,903,810 | 9/1975 | Jones | 104/166 |
| 4,059,053 | 11/1977 | Jones | 104/35 |
| 4,074,632 | 2/1978 | Kurahasi et al. | 104/166 X |
| 4,132,174 | 1/1979 | Ziegenfus | 104/48 |

FOREIGN PATENT DOCUMENTS

| | | | |
|---|---|---|---|
| 143655 | 8/1903 | Fed. Rep. of Germany | 104/49 |
| 1159993 | 12/1963 | Fed. Rep. of Germany | 104/49 |

*Primary Examiner*—Randolph Reese

*Attorney, Agent, or Firm*—Seidel, Gonda, Goldhammer & Panitch

[57] ABSTRACT

In a driverless vehicle conveyor system wherein a driverless vehicle rides on tracks, two straight sections of the tracks have adjacent ends spaced by a gap. A transfer vehicle is provided in the gap for supporting and transferring driverless vehicles across the gap. The transfer vehicles are mounted for oscillation about an upright axis from a receiving position adjacent one end of the gap to a discharge position adjacent the other end of the gap.

11 Claims, 8 Drawing Figures

DRIVERLESS VEHICLE CONVEYOR SYSTEM

BACKGROUND

Driverless vehicle conveyor systems of the general type involved herein are known. For example, see U.S. Pat. No. 3,858,262 which discloses a closed loop system wherein two straight sections of track have their ends interconnected by turn tables. After analyzing known systems, it has been concluded that they lack versatility.

There is a need for such a conveyor system which is adaptable for use as a small system (such as 12 feet wide and 30 feet long) and as a large system (such as more than 30 feet wide and more than 100 feet long). There is a need for such a system which is versatile in that it should not be limited to rounded ends but rather can have a closed loop which is rectangular, in a form of a pentagon wherein two straight sections have an included angle which is other than 90°, etc. There is also a need for a system of this general type which is less expensive, lighter in weight, and less complicated than prior art systems.

It has been concluded that in order to design a system having the attributes described above, such a system should not include a turntable. A turntable takes up too much space in a small system and is impractical in a large system. Turntables are further objectionable insofar as they require the use of reversible electric motors, special gears and bearings, which are expensive to purchase, use and maintain. At the same time, the system should be continuous and completely automatic while providing for accumulation of vehicles at predetermined locations as well as accumulation when one vehicle contacts another.

SUMMARY OF THE INVENTION

In a driverless vehicle system of the present invention driverless vehicles have support wheels which ride on tracks. Two straight sections of said tracks have adjacent ends spaced by a gap. A transfer vehicle is supported in the gap for supporting and transferring driverless vehicles across said gap. The transfer vehicle is mounted for oscillation about an upright axis from a receiving position adjacent one end of the gap to a discharge position adjacent the other end of the gap. A motor means is provided for oscillating the transfer vehicle. A means is provided for accumulating a driverless vehicle on one end of the straight sections of track when the transfer vehicle is not in its receiving position.

It is an object of the present invention to provide a driverless vehicle conveyor system which is versatile so as to be adapted for use in small and large systems while at the same time being light weight, inexpensive, simple, and reliable.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
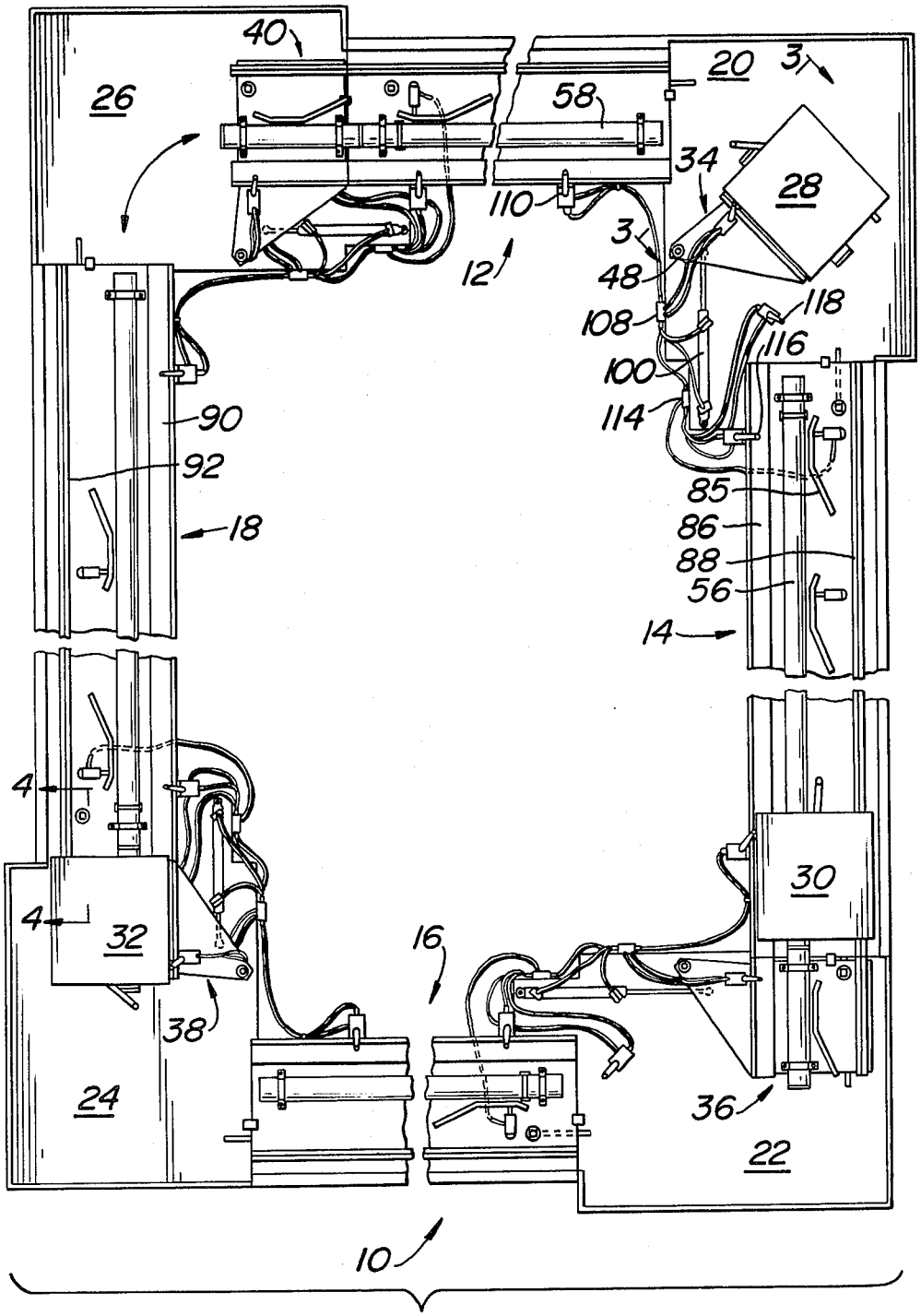
FIG. 1 is a top plan view of a system in accordance with the present invention.

Referring to the drawing in detail, wherein like numerals indicate like elements, there is shown in FIG. 1 a top plan view of a system in accordance with the present invention and adapted for use in small and large conveyor systems. For purposes of illustration, the system 10 is shown in the form of a rectangle comprised of straight sections 12, 14, 16 and 18 interconnected by corner sections 20, 22, 24 and 26, respectively. The number of vehicles capable of being handled by the system 10 is variable. For purposes of illustration, three driverless vehicles are illustrated in FIG. 1 and designated 28, 30 and 32.

Vehicle 28 is shown being transferred across the gap from section 14 to section 12 by a transfer vehicle 34. Vehicle 30 is shown moving along section 14 after having just been transferred thereto from section 16 by transfer vehicle 36. Vehicle 32 is shown being transferred onto the transfer vehicle 38 from the section 18. At corner section 26, the transfer vehicle 40 is shown in a position adapted to receive a driverless vehicle from section 12 and transfer the same to section 18. For purposes of illustration, traffic of the vehicles in FIG. 1 is counterclockwise.

The transfer of driverless vehicles from one section to another is identical. Hence, for purposes of illustration the invention will be described primarily in connection with vehicle 28 as it is transferred from section 14 to section 12. While such transfer of vehicle 28 from section 14 to section 12 is through an angle of 90°, the present invention is not limited to such 90° angles but rather may be 45°, 80°, 115°, etc.

Figure 5:
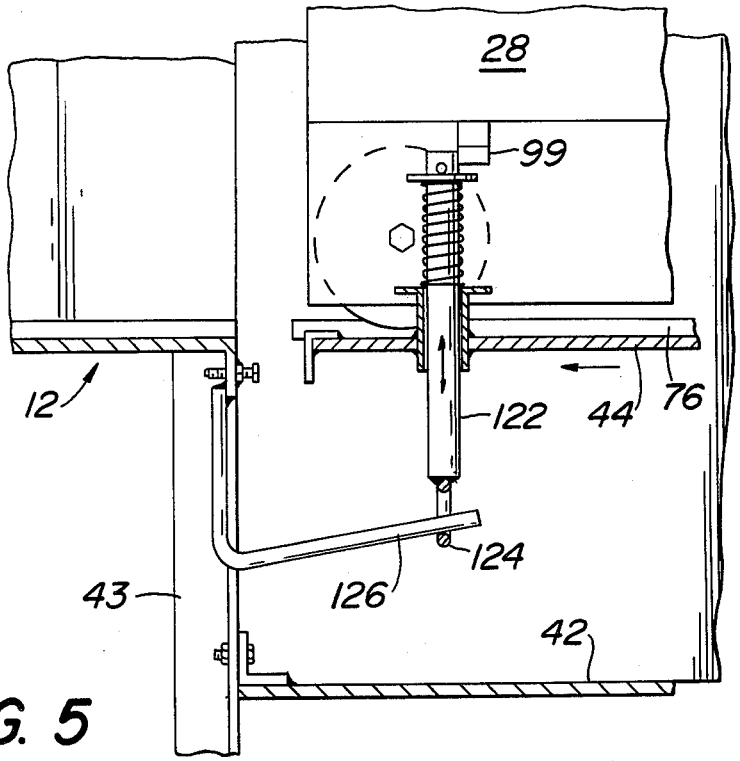
FIG. 5 is a sectional view showing the cart release mechanism.

At corner section 20, there is provided a horizontally disposed floor 42 which is at a lower elevation than the floor of sections 14 and 12. The respective floors are supported by vertical support channels 43. See FIG. 5.

Figure 2:
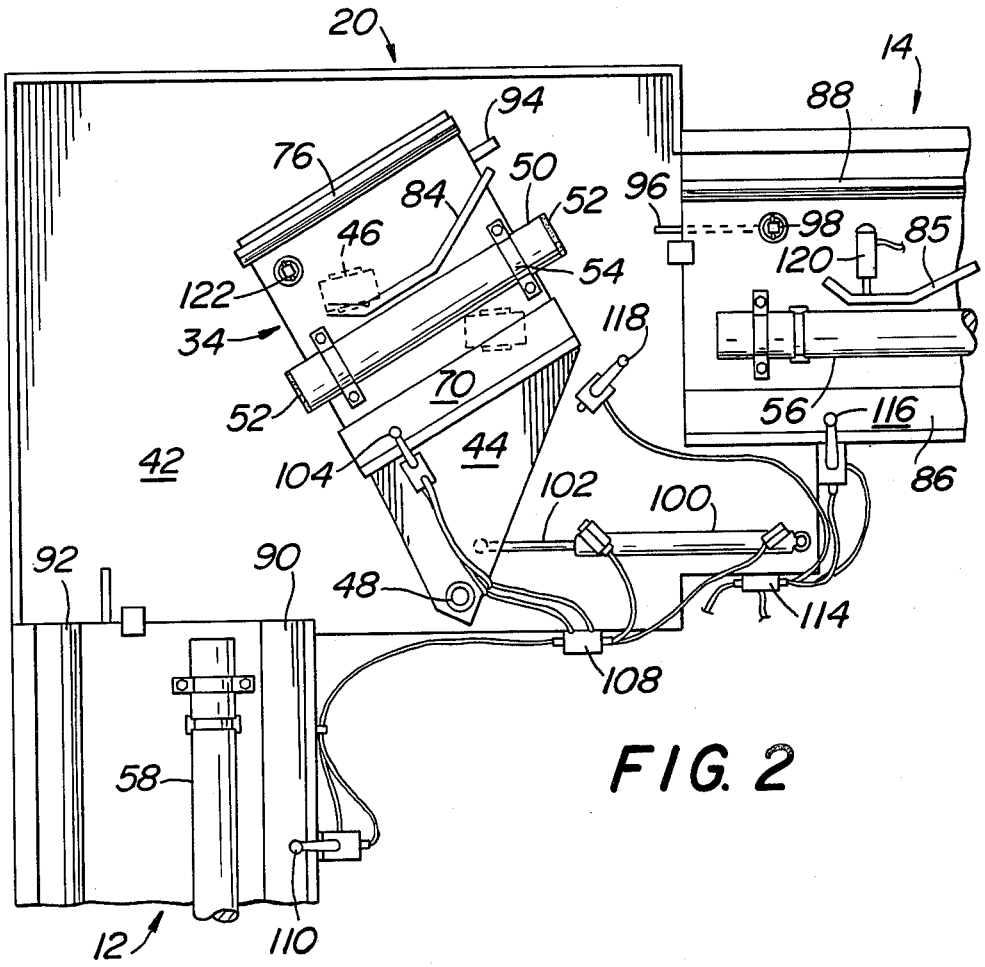
FIG. 2 is an enlarged detailed view of one corner of the system shown in FIG. 1.
Figure 6:
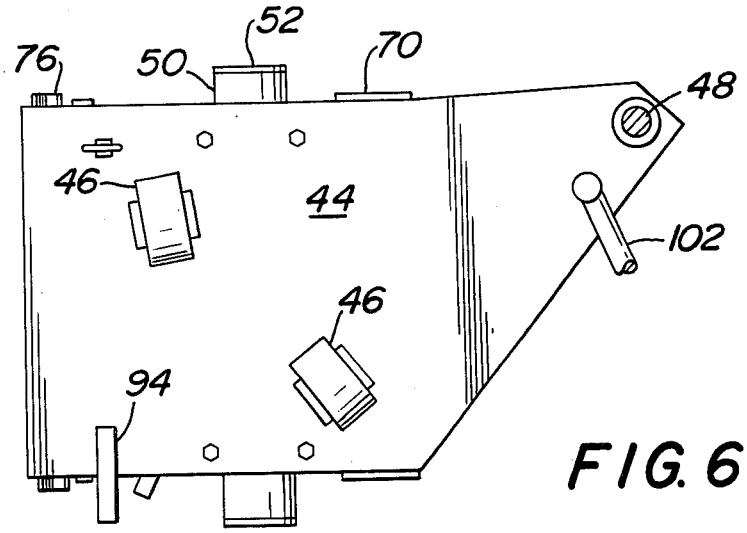
FIG. 6 is a bottom plan view of the transfer vehicle.
Figure 3:
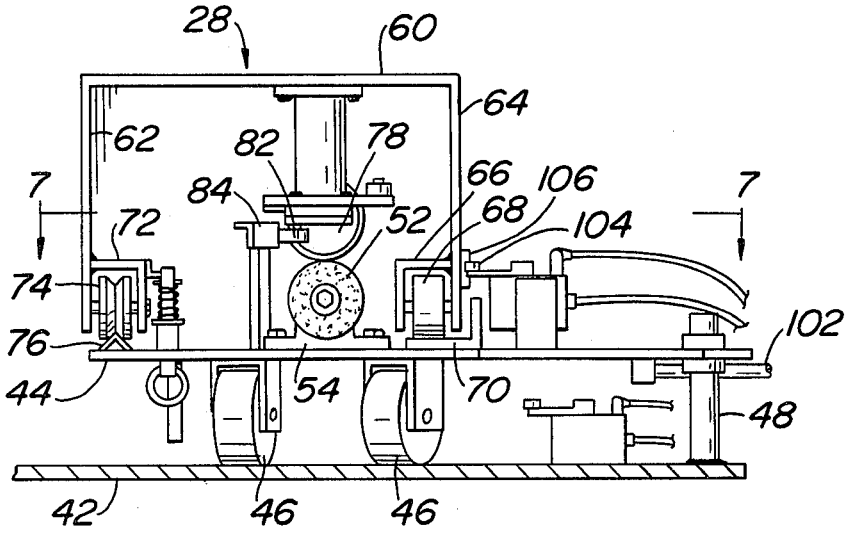
FIG. 3 is a sectional view taken along the line 3—3 in FIG. 1.

Referring to FIGS. 2, 3 and 6, the transfer vehicle 34 includes a horizontally disposed base 44 supported by wheels 46. Wheels 46 may be caster wheels but are preferably less expensive wheels fixedly mounted to the bottom of base 44 so that they rotate about an axis aligned with the vertical axis of a pin 48. A bearing surrounds pin 48 and the transfer vehicle 34 oscillates about the axis of pin 48.

The transfer vehicle 34 on its upper surface supports a drive shaft 50 having friction pads 52 at opposite ends. It will be noted that the drive shaft 50 is longer than the length of the base 44 whereby the drive shaft 50 projects beyond the opposite ends of the base 44. See FIGS. 2 and 6.

The drive shaft 50 is supported by a pair of bearings 54 at an elevation so as to correspond with the elevation of drive shaft 56 along section 14 and the elevation of drive shaft 48 along section 12. Drive shaft 56 and 58 are driven so as to rotate about their axis by discrete motors not shown. Drive shaft 50 does not have a drive motor of its own. Rotation of the drive shaft 56 will be utilized to transfer a vehicle 28 onto the transfer vehicle 34 while rotation of drive shaft 58 will be utilized to discharge vehicle 28 from the transfer vehicle 34 as will be explained hereinafter.

Figure 7:
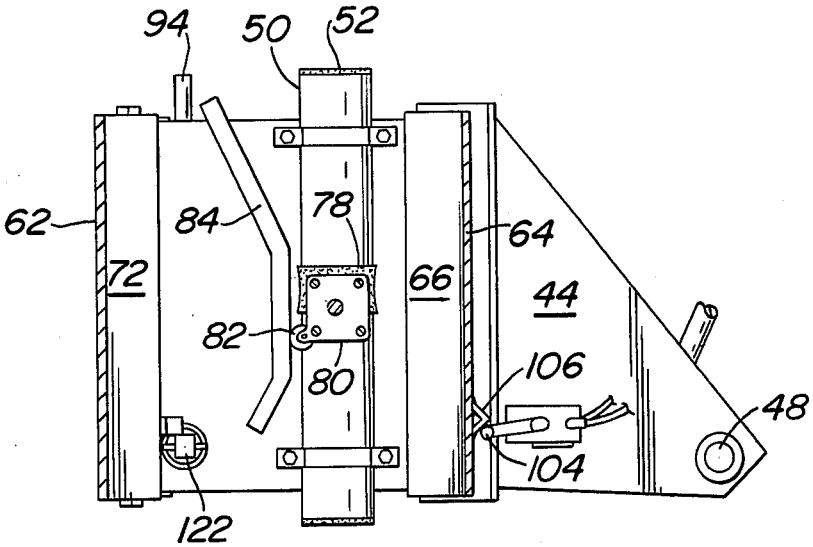
FIG. 7 is a sectional view taken along the line 7—7 in FIG. 3.

The vehicles 28, 30 and 32 are preferably designed in a manner so as to be inexpensive and simple while being capable of being utilized in an automatic conveyor system of the type involved herein. A preferred driverless vehicle is shown in FIGS. 3 and 7 as having a top wall 60 and downwardly extending side walls 62, 64. Thus, vehicle 28 is channel-shaped with the load supporting wall 60 integral in one piece and bent so as to define the side walls 62, 64. A channel 66 is welded to side wall 64 and they cooperate to support wheels 68 which ride on tracks 70. A channel 72 is welded to the side wall 62 and they cooperate to support wheels 74 which ride on track 76. Track 76 is inexpensively obtained by using a channel member welded to the base 44 with its apex extending upwardly for cooperation with a V-shaped groove in the wheels 74.

The vehicle 28 has a drive wheel 78 in frictional contact with the drive shaft 50. As is conventional, drive wheel 78 is normally spring biased to a drive position. As illustrated in FIG. 3, the drive wheel 78 has been cammed to an accumulation position wherein there is no driving force on the vehicle 28. The support 80 for the drive wheel 78 has a cam follower 82 which has been cammed to an accumulation position as shown in FIG. 7 by the cam 84 which is supported by the base 44. A cam 85, similar to cam 84, is provided adjacent the discharge end of the conveyor section 14.

Each of the conveyor sections 12, 14, 16 and 18 has tracks corresponding to tracks 70 and 76. As shown in FIG. 2, section 14 has a track 86 corresponding to track 70 and a track 88 corresponding to track 76. Likewise, section 12 has a track 90 corresponding to track 70 and a track 92 corresponding to track 76.

The transfer vehicle 34 has a cam 94 projecting upstream. See FIGS. 2, 6 and 7. Cam 94 is adapted to cooperate with lever 96 on the discharge end of the conveyor section 14. Lever 96 controls a vertically reciprocable limit stop 98 for positively holding vehicles on the section 14. Since vehicle 34 is shown at an intermediate position in the drawings, these elements will be described in connection with FIG. 4 which shows corresponding structure associated with transfer vehicle 38 and the discharge end of conveyor section 18 before release of vehicle 32.

Figure 4:
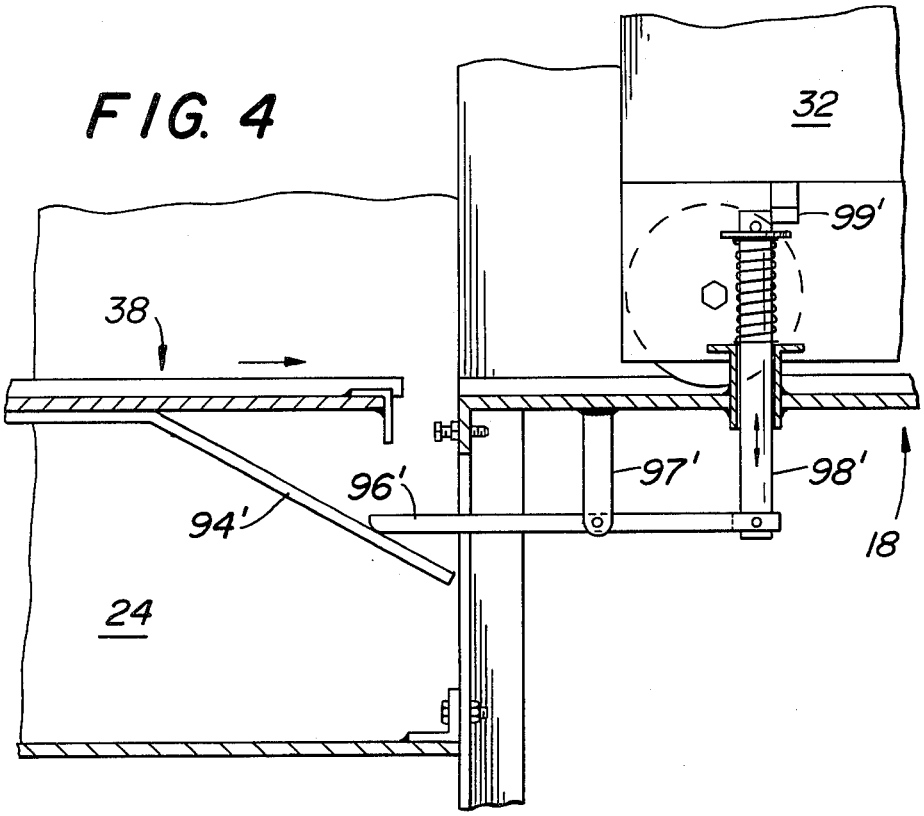
FIG. 4 is a sectional view taken along the line 4—4 in FIG. 1.

As shown in FIG. 4, the transfer vehicle 38 has a cam 94' which cooperate with the lever 96'. Lever 96' is pivotably supported by bracket 97' intermediate its ends. As the lefthand end of lever 96' is cammed upwardly in FIG. 4, the righthand end will move downwardly and retract the vertically reciprocable limit stop 98' due to the pivotable connection therebetween. Limit stop 98' is spring biased upwardly so that it may abut the limit stop 99' supported by the vehicle 32. As the transfer vehicle 38 reaches its receiving position, limit stop 98' will have been retracted downwardly sufficiently so as to cease interfering with the limit stop 99' whereby vehicle 32 may transfer onto the transfer vehicle 38. The structure having primed numerals in FIG. 4 corresponds to the unprimed numerals in other figures of the drawings.

The transfer vehicle 34 is oscillated about the vertical axis of pin 48 by cylinder 100. Cylinder 100 contains a piston connected to a piston rod 102. One end of the pistion rod 102 is pivotably connected to the base 44. One end of the cylinder 100 is pivotably connected to the floor 42. A pneumatic pilot valve actuator 104 is supported on the base 44 of the transfer vehicle 34 in a position so that it may be actuated by the actuator 106 on the outer surface of the side wall 64 of vehicle 28. Pilot valve actuator 104 controls part of a supply and exhaust valve 108 to supply pneumatic fluid to cylinder 100 for extending the piston rod 102. When vehicle 28 has transferred onto track section 12 actuator 106 contacts pilot valve actuator 110 which controls part of valve 108 to supply fluid to cylinder 100 for retracting piston rod 102.

Figure 8:
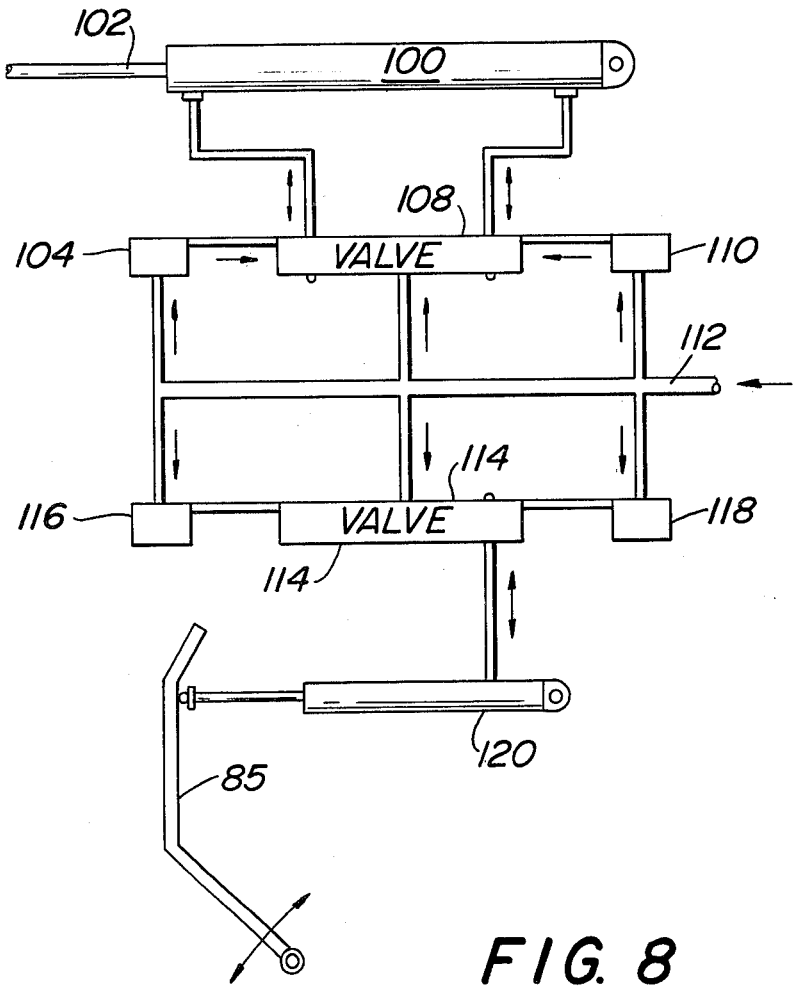
FIG. 8 is a circuit diagram.

Referring to FIG. 8, the control fluid such as pressurized air is supplied by manifold conduit 112. Conduit 112 is connected to valves 108, 114 and to the pilot valve actuators 104, 110. Valves 108, 114 are supply and exhaust valves. Valve 114 is provided with pilot valve actuators 116, 118. Valve 114 controls the supply of fluid to cylinder 120. Cylinder 120 is pivoted to the base of track section 14 and is adapted to pivot control cam 85 between a vehicle accumulation position and a vehicle release position. The piston within cylinder 120 is spring biased to a release position. The spring is opposed by air pressure when pilot valve actuator 116 is tripped just when a vehicle 28 is transferring onto the transfer vehicle 34. The air pressure in cylinder 120 is released whereby the spring may bias the control cam 85 to a release position when pilot valve actuator 118 is tripped by the transfer vehicle 34 only on its return trip. Pilot valve actuator 118 is mounted on the floor 42. See FIGS. 1 and 2.

Transfer vehicle 34 has a spring biased limit stop 122 identical to limit stop 98. While vehicle 28 is on the transfer vehicle 34 it is prevented from discharging by contact between limit stop 122 and limit stop 99 on vehicle 28. See FIG. 5. A ring or equivalent is secured to the lower end of limit stop 122. A rod-like cam 126 is mounted on the support channel 43 adjacent one end of the track section 12. As the transfer vehicle 34 moves from right to left in FIG. 5, cam 126 cams the limit stop 122 downwardly to thereby release the vehicle 28 for discharge onto the track section 12.

DESCRIPTION OF OPERATION

Vehicles 28, 30, 32 etc. continuously circulate around the system 10. A control cam similar to cam 85 is provided along the track sections 12, 14, 16 and 18 where it is desired to have the driverless vehicles temporarily accumulate during which time the vehicles are loaded, unloaded, or some other type of work is performed. When vehicle 28 reaches the end of track section 14 adjacent the corner section 20, it will transfer onto the transfer vehicle 34 depending on the position of vehicle 34. If transfer vehicle 34 is in its vehicle receiving position, limit stop 98 is in an inoperative retracted position and control cam 85 will be spring biased to an inoperative position. When actuator 106 contacts the pilot valve actuator 116 just as the vehicle is leaving track section 14, valve 114 is shifted so as to introduce air into the cylinder 120 which extends the control cam 85 to an accumulation position for accumulating the next vehicle on track section 14.

While the transfer vehicle 34 is in its receiving position, there is sufficient stroke left in connection with the piston in cylinder 100 whereby friction pad 52 on the drive shaft 50 is held by the cylinder 100 in contact with one end of the drive shaft 56. Rotation of drive shaft 56 causes drive shaft 50 to rotate. Vehicle 28 transfers onto the transfer vehicle 34. The driverless vehicle 28 is slowed down by contact between the control cam 84 and the cam follower 82. Limit stop 122 on the transfer vehicle 34 contacts the limit stop 99 on the driverless vehicle 28 to thereby positively and mechanically hold vehicle 28 in a stationary position. Actuator 106 trips the pilot valve actuator 104 whereby cylinder 100 is stroked to oscillate the transfer vehicle 34 to its discharge position.

When the transfer vehicle 34 approaches the end of the gap adjacent track section 12, there is still sufficient stroke left whereby the cylinder 100 will cause pad 52 on the drive shaft 50 to engage and remain in contact with the drive shaft 58 which will drive the shaft 50. Cam 126 cams the limit stop 122 downwardly to release the vehicle 28. Vehicle 28 transfers onto the tracks 90, 92 and thereafter trips the pilot valve actuator 110. Pilot valve actuator 110 shifts the valve 108 so that fluid is supplied to the cylinder 100 to return the transfer vehicle 34 to its receiving position.

As the vehicle 34 returns to its receiving position, it trips the pilot valve actuator 118 to cause valve 114 to exhaust the cylinder 120. The spring in cylinder 120 retracts the control cam 85 thereby releasing the next vehicle insofar as cam 85 is concerned. When the transfer vehicle 34 is in its receiving position, cam 94 retracts limit stop 98. The next vehicle is then transferred onto the transfer vehicle 34 and the process is repeated as set forth above.

The conduits described above are flexible. The entire transfer action is pneumatically controlled at each of the corner sections thereby eliminating the need for electricity and electrical components. Each of the drive shafts on the sections 12, 14, 16 and 18 are rotated about their longitudinal axis by electrical drive motors in a conventional manner. Since one of the tracks for the driverless vehicles 28, 30, 32, etc. is V-shaped in section with its apex extending upwardly, additional wheels to prevent driverless vehicles from losing contact with their tracks are not needed. The system 10 is versatile in that it may be utilized on small and large conveyor systems merely by choosing desired lengths for the track sections 12, 14, 16 and 18 while at the same time enabling the system 10 to have different shapes such as rectangular, pentagon, hexagon, etc. It will be noted that turntables are not utilized.

The present invention may be embodied in other specific forms without departing from the spirit or essential attributes thereof and, accordingly, reference should be made to the appended claims, rather than to the foregoing specification, as indicating the scope of the invention.

What is claimed is:

1. In a driverless vehicle system wherein a driverless vehicle has support wheels which ride on tracks, comprising two straight non-parallel sections of track having adjacent ends spaced from one another by a gap, a drive shaft parallel to the tracks in each of said straight sections, a transfer vehicle in said gap for supporting and transferring driverless vehicles across the gap from one straight section to the other, a drive shaft on said transfer vehicle, said transfer vehicle being mounted for oscillation along an arc about an upright axis from a receiving position adjacent one end of the gap to a discharge position adjacent the other end of the gap, said upright axis being located within the included angle defined by an extension of the axes of said drive shafts in said straight sections, motor means connected to said transfer vehicle for oscillating said transfer vehicle, means for causing the rotation of one drive shaft associated with one of said straight sections to transfer a driverless vehicle onto the transfer vehicle and for using rotation of the drive shaft associated with the other straight section to discharge a driverless vehicle off the transfer vehicle, means for accumulating a driverless vehicle on one end of said straight sections of track when said transfer vehicle is not in its receiving position, limit stop means on the transfer vehicle for restraining a vehicle from discharging off the transfer vehicle, and means for releasing the last mentioned limit stop means when the transfer vehicle is in its discharge position.

2. In a system in accordance with claim 1 wherein the drive shaft on the transfer vehicle has friction pads on its ends and is at the same elevation as the drive shafts associated with the straight section, and said means for oscillating said transfer vehicle being arranged to apply pressure for maintaining the drive shaft on the transfer vehicle in contact with an end face of a drive shaft associated with one of the straight sections when the transfer vehicle is at one end of said gap.

3. A system in accordance with claim 1 wherein there are at least four of said straight sections of tracks with a discrete corner member connecting adjacent ends of two straight sections, each corner member having a support surface for supporting said transfer vehicle as it oscillates between the receiving position and discharging position.

4. A system in accordance with claim 1 including an actuator adjacent one end of said straight sections for actuation by a driverless vehicle to control said accumulating means so that the next vehicle will accumulate in the event that the transfer vehicle is not in its receiving position.

5. In a system in accordance with claim 1 including a device on the transfer vehicle for actuation by a driverless vehicle for initiating oscillation of the transfer vehicle from its receiving position toward its discharge position.

6. A system in accordance with claim 5 including a device downstream from the receiving position of the transfer vehicle for contact with a driverless vehicle to initiate return of the transfer vehicle from its discharging position to its receiving position.

7. A system in accordance with claim 1 including a corner member in said gap between said straight sections, said transfer vehicle having wheels supported by said corner member.

8. In a driverless vehicle system wherein a driverless vehicle has support wheels which ride on tracks, means defining a gap between adjacent ends of first and second non-parallel sets of said tracks, a discrete drive shaft parallel to each set of tracks, a drive wheel on each driverless vehicle, each drive wheel being in rolling contact with one of said drive shafts, each drive wheel being movable between a drive position and an accumulation position, a transfer vehicle in said gap for supporting and transferring driverless vehicles across said gap, said transfer vehicle having tracks and a drive shaft parallel thereto, means supporting said transfer vehicle for oscillation about an upright axis from a receiving position adjacent one end of the gap to a discharging position adjacent the other end of the gap, said upright axis being located within the included angle defined by an extension of the axes of said drive shafts and spaced from the transfer vehicle, and motor means for oscillating said transfer vehicle between said positions.

9. In a system in accordance with claim 8 wherein said motor means is a fluid cylinder having a piston rod pivotably connected to said transfer vehicle.

10. In a system in accordance with claim 9 including a device on the transfer vehicle for actuation by a driverless vehicle to initiate actuation of said fluid cylinder.

11. In a driverless vehicle system wherein a driverless vehicle has support wheels which ride on tracks comprising two straight non-parallel sections of tracks having adjacent ends spaced from one another by a gap, a transfer vehicle in said gap for supporting and transferring driverless vehicles across the gap from one straight section to the other, said transfer vehicle being mounted only for oscillation along an arc about an upright axis from a receiving position adjacent one end of the gap to a discharge position adjacent the other end of the gap, motor means connected to said transfer vehicle for oscillating said transfer vehicle, means for accumulating a driverless vehicle on one end of said straight sections of track when said transfer vehicle is not in its receiving position including an actuator adjacent one end of said straight sections for actuation by a driverless vehicle to control said accumulating means so that the next vehicle will accumulate in the event that the transfer vehicle is not in its receiving position, limit stop means on the transfer vehicle for restraining a vehicle from discharging off the transfer vehicle, means for releasing the last mentioned limit stop means when the transfer vehicle is in its discharge position, a device on the transfer vehicle for actuation by a driverless vehicle for initiating oscillation of the transfer vehicle from its receiving position toward its discharge position, and a device downstream from the receiving position of the transfer vehicle for contact with a driverless vehicle to initiate return of the transfer vehicle from its discharging position to its receiving position.

* * * * *